US007367324B2

(12) United States Patent
Izutani et al.

(10) Patent No.: US 7,367,324 B2
(45) Date of Patent: May 6, 2008

(54) FUEL FEED APPARATUS HAVING CANISTER

(75) Inventors: Kouji Izutani, Nagoya (JP); Keiichi Yamashita, Kariya (JP); Noriya Matsumoto, Okazaki (JP); Koji Miwa, Toyota (JP)

(73) Assignee: Denso Corporation (JP)

( * ) Notice: Subject to any disclaimer, the term of this patent is extended or adjusted under 35 U.S.C. 154(b) by 36 days.

(21) Appl. No.: 11/408,075

(22) Filed: Apr. 21, 2006

(65) Prior Publication Data

US 2006/0236982 A1 Oct. 26, 2006

(30) Foreign Application Priority Data

Apr. 21, 2005 (JP) ..... 2005-123159

(51) Int. Cl.
*F02M 37/02* (2006.01)

(52) U.S. Cl. ..... 123/509; 123/518; 123/519

(58) Field of Classification Search ..... 123/516, 123/518, 519, 520, 509
See application file for complete search history.

(56) References Cited

U.S. PATENT DOCUMENTS 4,919,103 A * 4/1990 Ishiguro et al. ..... 123/514
5,992,394 A * 11/1999 Mukaidani et al. ..... 123/509
6,182,693 B1 * 2/2001 Stack et al. ..... 137/565.17
6,302,144 B1 * 10/2001 Graham et al. ..... 137/565.17
6,354,280 B1 * 3/2002 Itakura et al. ..... 123/519
7,143,750 B2 * 12/2006 Brunel et al. ..... 123/509
7,159,576 B2 * 1/2007 Yamashita et al. ..... 123/509
7,159,578 B2 * 1/2007 Horvath et al. ..... 123/518

FOREIGN PATENT DOCUMENTS

JP 2004-251165 9/2004

OTHER PUBLICATIONS

Chinese Official Action dated Oct. 26, 2007 issued in corresponding Chinese Application No. 200610074620.5 with English translation.

* cited by examiner

*Primary Examiner*—Thomas Moulis
(74) *Attorney, Agent, or Firm*—Nixon & Vanderhye PC

(57) ABSTRACT

A fuel feed apparatus is provided to a fuel tank. The fuel feed apparatus includes a lid member, a canister, and a fuel pump. The lid member covers a through hole of the fuel tank. The canister connects with the lid member. The canister is accommodated in the fuel tank for removably absorbing fuel vapor in the fuel tank. The canister has a cross section, which is in a substantially semicircle shape. The canister has an outer peripheral wall that partially defines a remaining space on the lateral side of the canister. The fuel pump is received in the remaining space on the lateral side of the canister in the fuel tank for pumping fuel in the fuel tank.

18 Claims, 5 Drawing Sheets

FUEL FEED APPARATUS HAVING CANISTER

CROSS REFERENCE TO RELATED APPLICATIONS

This application is based on and incorporates herein by reference Japanese Patent Application No. 2005-123159 filed on Apr. 21, 2005.

FIELD OF THE INVENTION

The present invention relates to a fuel feed apparatus having a canister.

BACKGROUND OF THE INVENTION

According to JP-A-251165, a canister is mounted in a fuel tank together with a fuel feed apparatus, so that mountability of the fuel feed apparatus is enhanced. The canister is capable of removably absorbing fuel vapor in a fuel tank. In this structure, the canister is mounted to a flange of the fuel feed apparatus. The flange covers a through hole of the fuel tank. The canister is offset with respect to a sub tank receiving a fuel pump of the fuel feed apparatus.

A canister may be heated to enhance removability of fuel vapor. In the above structure of the canister, the fuel pump is surrounded by the sub tank, and being distant from the canister. Accordingly, heat generated in the fuel pump cannot be used for heating the canister. Consequently, the fuel feed apparatus needs an additional heater for heating the canister. In this structure including the additional heater, the fuel feed apparatus is jumboized, and mountability of the fuel feed apparatus is impaired.

SUMMARY OF THE INVENTION

In view of the foregoing and other problems, it is an object of the present invention to produce a readily mountable fuel feed apparatus including a canister having high removability.

According to one aspect of the present invention, a fuel feed apparatus is provided to a fuel tank. The fuel feed apparatus includes a lid member, a canister, and a fuel pump. The lid member covers a through hole of the fuel tank. The canister connects with the lid member. The canister is accommodated in the fuel tank. The canister is adapted to removably absorbing fuel vapor in the fuel tank. The fuel pump is adapted to pumping fuel in the fuel tank. The canister has a cross section, which is in substantially semicircle having a chord. The canister has an outer peripheral wall that defines a space, which is on a lateral side of the chord of the cross section of the canister, in the fuel tank. The space receives the fuel pump.

Alternatively, a fuel feed apparatus is provided to a fuel tank. The fuel feed apparatus includes a lid member, a canister, a fuel pump, and a suction filter. The lid member covers a through hole of the fuel tank. The canister connects with the lid member. The canister is accommodated in the fuel tank. The canister is adapted to removably absorbing fuel vapor in the fuel tank. The fuel pump is located in a space on a lateral side of the canister in the fuel tank. The fuel pump is adapted to pumping fuel in the fuel tank. The suction filter is accommodated in the fuel tank for filtering fuel drawn from the fuel tank into the fuel pump. The suction filter is located on a substantially opposite side of the lid member with respect to the fuel pump. The canister, the fuel pump, and the suction filter are received in a projection area of the lid member on the side of the suction filter.

In this structure, heat generated in the fuel pump can be transmitted to the canister, so that performance of removability of fuel absorbed in the canister can be enhanced by heating the canister utilizing thermal energy generated in the fuel pump. Furthermore, the space can be efficiently used for receiving the fuel pump, so that the fuel feed apparatus can be downsized.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
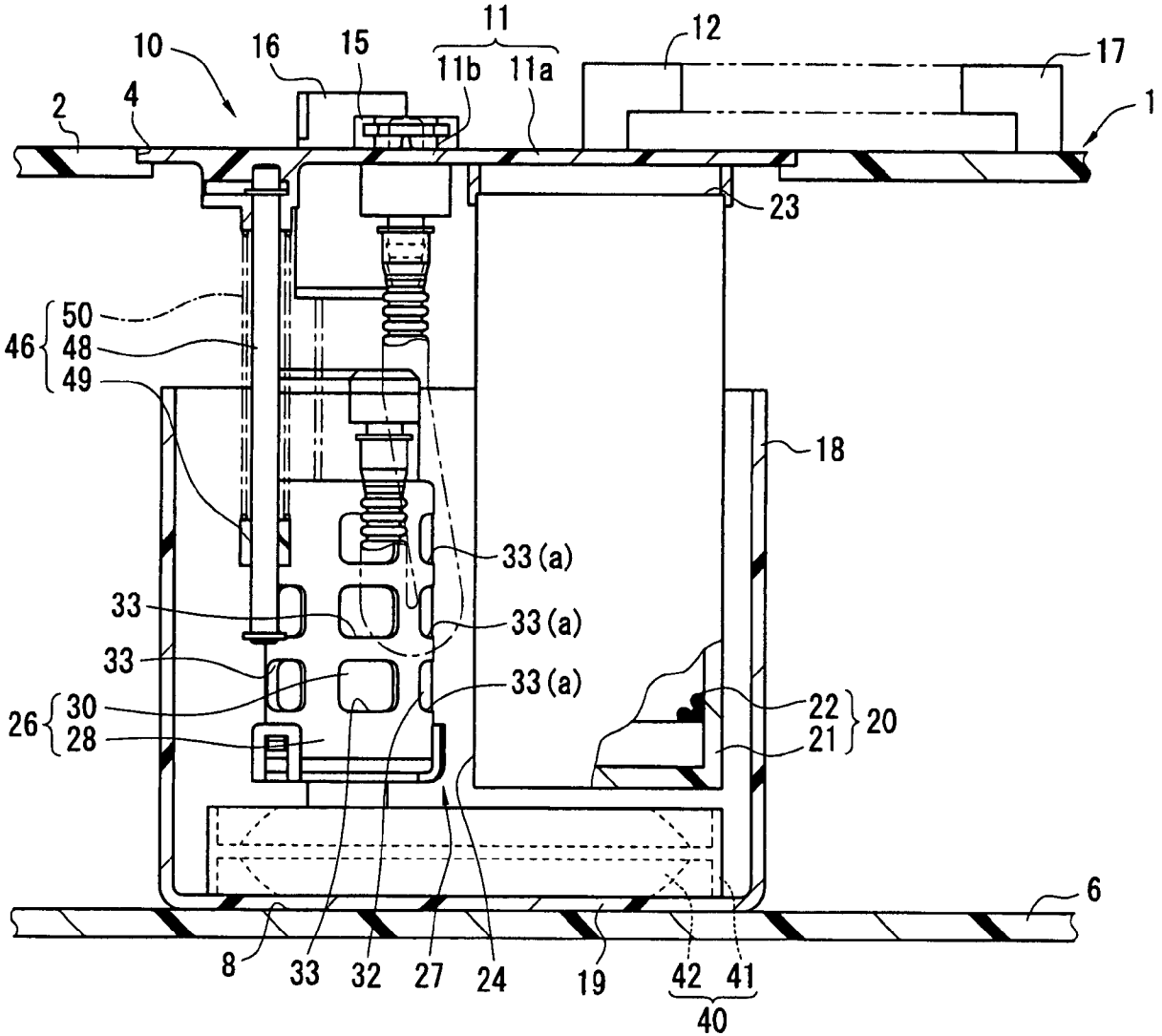
FIG. 1 is a partially cross sectional side view showing a fuel feed apparatus mounted to a fuel tank, according to a first embodiment of the present invention.
Figure 2:
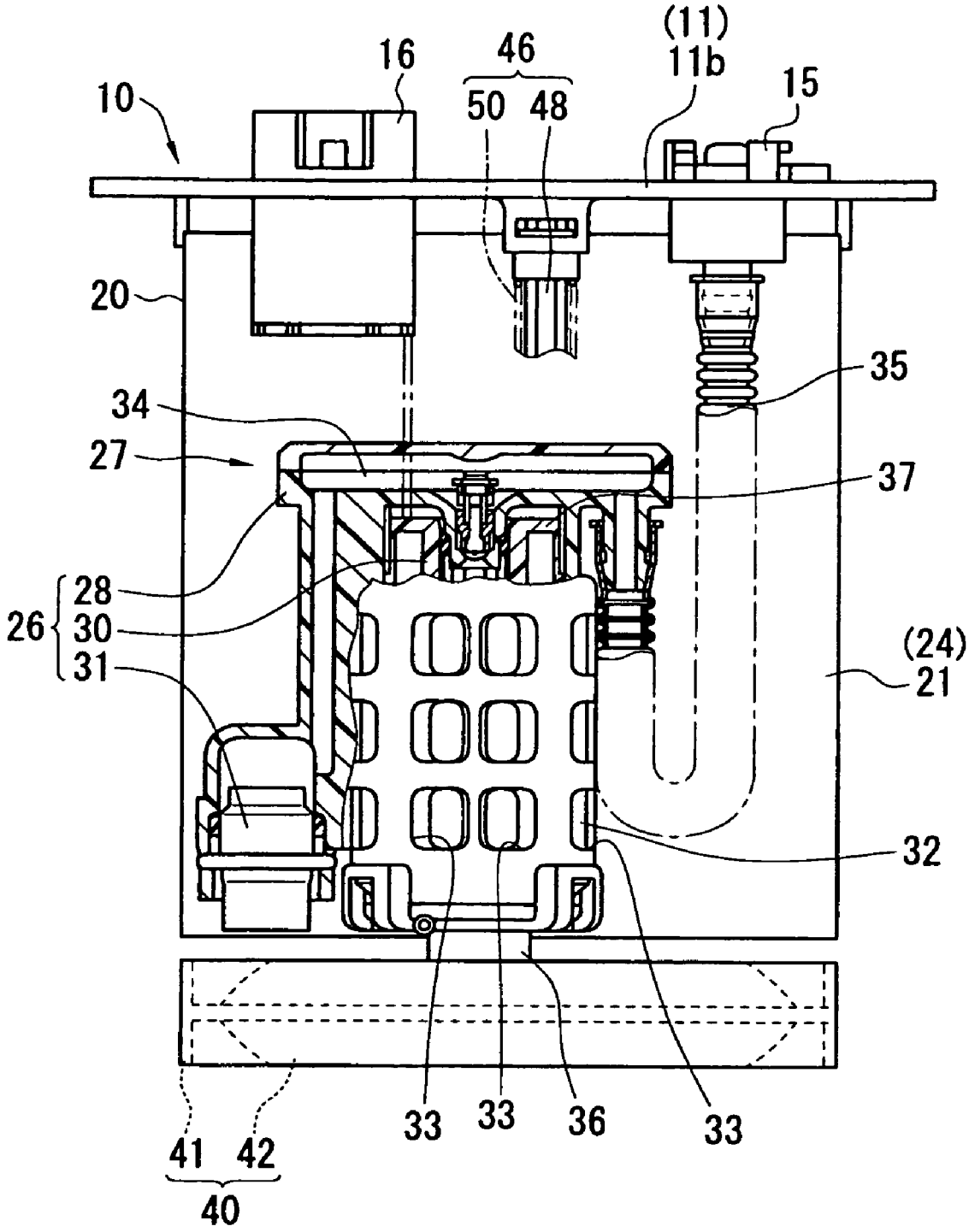
FIG. 2 is a partially cross sectional side view showing the fuel feed apparatus according to the first embodiment.
Figure 3:
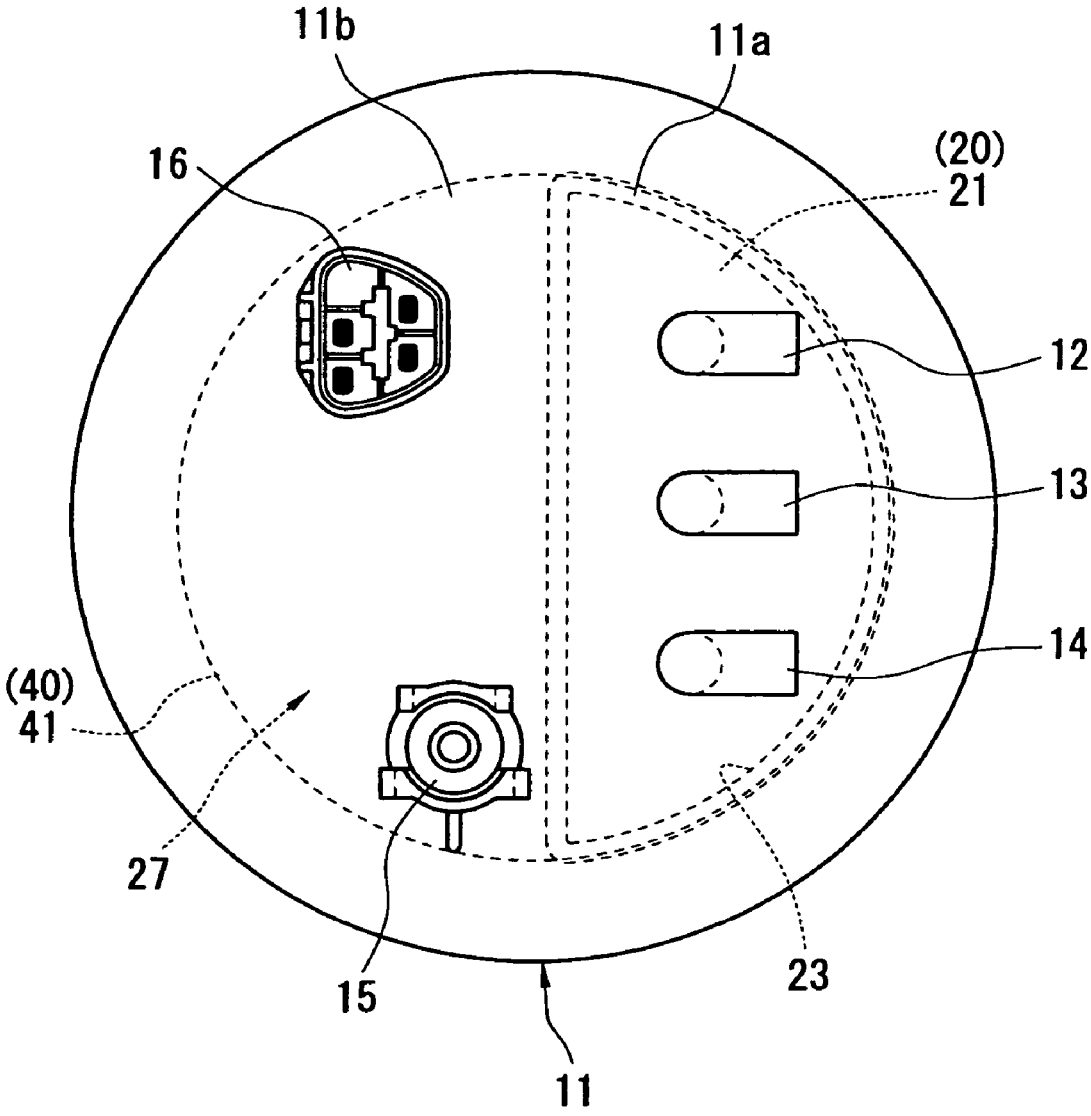
FIG. 3 is a top view showing the fuel feed apparatus according to the first embodiment.

The structure of a fuel feed apparatus 10 is described in reference to FIGS. 1 to 3. The vertical direction, upper and lower directions in FIG. 1 substantially corresponds to the vertical direction of the fuel feed apparatus 10. The fuel feed apparatus 10 is provided to a vehicle having an internal combustion engine. The fuel feed apparatus 10 has a substantially disc-shaped flange 11 that is attached to a through hole 4 formed in a fuel tank 1, so that the flange 11 covers the through hole 4. The flange 11 serves as a lid member. The flange 11 has a vapor inlet pipe 12, a vapor outlet pipe 13, a vent pipe 14, a fuel discharge pipe 15, and an electric connecter 16.

The vapor inlet pipe 12 introduces fuel vapor, which is generated in the fuel tank 1, into the canister 20 through a fuel exhaust pipe 17 provided to an upper portion 2 of the fuel tank 1.

The vapor outlet pipe 13 introduces fuel vapor removed from the canister 20 to an air intake pipe of the internal combustion engine in the outside of the fuel tank 1. The inside of the canister 20 communicates with the atmosphere through the vent pipe 14. Fuel discharged from the fuel pump 30 is supplied to the engine through the fuel discharge pipe 15. The electric connecter 16 electrically connects with an external power source for supplying the fuel pump 30 with electricity. A sub tank 18 is accommodated in the fuel tank 1 such that the sub tank 18 is on a bottom portion 6 of the fuel tank 1. In this embodiment, the sub tank 18 is in a substantially cup-shape having an opening on the upper side of the sub tank 18. Fuel flows from the fuel tank 1 into the sub tank 18.

The fuel feed apparatus 10 includes components 20, 26, 40, and 46, in addition to the flange 11. The components 20, 26, 40, and 46 are accommodated in the fuel tank 1.

The canister 20 is constructed by filling an absorbent 22 into a canister case 21. The canister case 21 is in a bottomed substantially cylindrical shape having the cross section in a substantially semicircle shape. The canister case 21 has the diameter less than the diameter of the flange 11. The canister case 21 engages with the flange 11, so that the canister case 21 is supported by the flange 11. The canister case 21 is accommodated in the sub tank 18. The canister case 21 has an opening 23, which is covered with a first portion 11*a* of the flange 11. The pipes 12 to 14 are provided to the first portion 11*a* of the flange 11. In this covered structure, the canister 20 is received in a projection area (projection area of the flange 11) on the lower side of the flange 11.

This projection area of the flange 11 may be defined by projecting the plain surface of the flange 11 on the lower side, i.e., on the bottom portion 6 of the fuel tank 1, for example. This projection area of the flange 11 may substantially correspond to the area of the through hole 4 of the fuel tank 1, for example.

The absorbent 22 is formed of an activated charcoal, for example. The absorbent 22 removably absorbs fuel vapor introduced into the canister case 21 through the vapor inlet pipe 12. Negative pressure in the air intake pipe is applied to the absorbent 22 through the vapor outlet pipe 13, so that fuel absorbed in the absorbent 22 is removed by an operation of negative pressure in the air intake pipe. The fuel removed from the absorbent 22 is introduced to the air intake pipe through the vapor outlet pipe 13 by the operation of negative pressure in the air intake pipe.

The fuel pump 30 and a pressure regulator 31 are assembled to a pump holder 28, so that a pump unit 26 is constructed. The pump holder 28 substantially surrounds an outer peripheral wall 32 of the fuel pump 30. The pump unit 26 is arranged in a remaining space 27 laterally with respect to the canister 20 in the sub tank 18.

More particularly, the canister 20 has the cross section with respect to the axial direction of the canister 20. This cross section is in substantially semicircle having a chord. The canister 20 has an outer peripheral wall 24 that defines the remaining space 27 on the lateral side of the chord of the cross section of the canister 20 in the sub tank 18. When the sub tank 18 is omitted from the fuel feed apparatus 10, the remaining space 27 is defined on the lateral side of the chord of the cross section of the canister 20 in the fuel tank 1.

In this arrangement, the pump unit 26 is located on the lower side of a second portion 11*b* of the flange 11, thereby being received in the projection area of the flange 11. The second portion 11*b* of the flange 11 is in a substantially semicircular shape. The fuel discharge pipe 15 and the electric connector 16 are provided to the second portion 11*b* of the flange 11.

The pump holder 28 has multiple windows 33, through which the outer peripheral wall 32 of the fuel pump 30 is exposed. The outer peripheral wall 32 of the fuel pump 30 oppose to an outer peripheral wall 24 of the canister case 21 through the windows 33. The pump holder 28 has a fuel passage 34. The fuel passage 34 has one end that connects with the fuel discharge pipe 15 via a bellows tube 35. The fuel passage 34 has the other end that connects with the pressure regulator 31. The fuel passage 34 has a center portion that connects with a fuel outlet 37 of the fuel pump 30. In this structure, fuel discharged from the fuel pump 30 is partially supplied to the fuel discharge pipe 15 through the fuel passage 34. The remaining fuel, excluding the fuel partially supplied to the fuel discharge pipe 15, is supplied to the pressure regulator 31.

The fuel pump 30 has a fuel inlet 36 on the lower side of the fuel feed apparatus 10. The fuel outlet 37 of the fuel pump 30 is on the upper side of the fuel feed apparatus 10. The fuel pump 30 generates suction force using driving power of an inner motor, thereby drawing fuel in the sub tank 18 through the fuel inlet 36 after passing through a suction filter 40. The fuel pump 30 pressurizes the fuel drawn from the sub tank 18, thereby discharging the fuel into the fuel passage 34 through the fuel outlet 37.

The pressure regulator 31 controls pressure of fuel flowing into the fuel discharge pipe 15 through the fuel passage 34, and exhausts surplus fuel, which is generated in this pressure control of the pressure regulator 31, to the upper side of the suction filter 40 in the sub tank 18.

The suction filter 40 has a supporting member 41, which supports a filter element 42. The filter element 42 connects with the fuel inlet 36 of the fuel pump 30. The suction filter 40 is arranged on the lower side of the pump unit 26 in the sub tank 18, so that the suction filter 40 partially enters into an area on the lower side of the canister 20. That is, the suction filter 40 is arranged on a substantially opposite side of the flange 11 with respect to the pump unit 26. In addition, the suction filter 40 is at least partially located on a substantially opposite side of the flange 11 with respect to the canister 20. In particular, in this embodiment, as shown in FIG. 3, the supporting member 41 defines the outermost periphery of the suction filter 40. The supporting member 41 has a substantially circular outline having the diameter less than the diameter of the flange 11, so that the suction filter 40 is received in the projection area of the flange 11.

The filter element 42 extends on a bottom portion 19 of the sub tank 18, so that the filter element 42 is capable of filtering fuel flowing into the fuel pump 30 from the sub tank 18. The filter element 42 is one kind of an integrated filter being capable of filtering small debris in addition to large debris. This large debris is supposed to be filtered using a filter element of a conventional suction filter having a general structure.

An adjustable unit 46 is received in the remaining space 27 on the lateral side of the canister 20 in the sub tank 18. The adjustable unit 46 is constructed of a pillar 48, a stay 49, and a compression spring 50. In this arrangement, the adjustable unit 46 is located on the lower side of the second portion 11*b* of the flange 11, so that the adjustable unit 46 is received in the projection area of the flange 11.

The pillar 48, which is in a substantially rod shape, vertically extends. The pillar 48 has the upper end that is supported by the second portion 11*b* of the flange 11. The pillar 48 has the lower end that extends into the sub tank 18. The stay 49 is formed integrally with the pump holder 28, such that the stay 49 is slidable relatively to the pillar 48. In this structure, the stay 49 substantially vertically moves along the pillar 48, so that the positions of the pump unit 26 and suction filter 40 can be adjusted relative to the flange 11.

The compression spring 50 serves as a bias member. The compression spring 50 is interposed between the second portion 11*b* of the flange 11 and the stay 49. Resiliency of the compression spring 50 applies biasing force to both the pump unit 26 and suction filter 40 such that the pump unit 26 and suction filter 40 are biased to the substantially opposite side of the flange 11, so that the pump unit 26 and suction filter 40 are biased onto an inner wall 8 of the bottom portion 6 of the fuel tank 1. In this structure, the suction filter 40 can be regularly pressed onto the bottom portion 6 of the fuel tank 1 via the bottom portion 19 of the sub tank 18, even when the fuel tank 1 expands as temperature changes around the fuel tank 1. Therefore, the suction filter 40 and pump unit 26 can be restricted from moving relative to the fuel tank 1.

In this embodiment, the pump unit 26 is arranged in the remaining space 27 defined on the lateral side of the canister 20 in the fuel tank 1. The outer peripheral wall 32 of the fuel pump 30 opposes to the outer peripheral wall 24 of the canister case 21. In this structure, heat generated in the fuel pump 30 can be transmitted to the canister case 21, so that the absorbent 22 in the canister case 21 can be heated. Furthermore, the remaining space 27 can be efficiently used for receiving the canister 20, so that the fuel feed apparatus 10 can be downsized. Thus, mountability of the fuel feed apparatus 10, particularly to a vehicle, can be enhanced by downsizing the fuel feed apparatus 10, while enhancing the performance of removability of fuel absorbed in the canister 20 by heating the canister 20 utilizing thermal energy generated in the fuel pump 30.

In addition, in this embodiment, the suction filter 40 is arranged on the opposite side of the flange 11 with respect to the pump unit 26. In this structure, clean fuel can be drawn into the fuel pump 30, without interrupting transmission of heat from the fuel pump 30 to the canister 20. Furthermore, in this embodiment, the suction filter 40 enters to the opposite side of the flange 11 with respect to the canister 20. In this structure, the volume of the suction filter 40 increases to the side of the canister 20, so that a filtering performance of the suction filter 40 can be enhanced.

Furthermore, in this embodiment, the components 20, 26, 40, and 46 of the fuel feed apparatus 10 excluding the flange 11 are received in the projection area of the flange 11. In this structure, the components 20, 26, 40, and 46 can be inserted into the fuel tank 1 through the through hole 4, after completing the assembling work of the fuel feed apparatus 10 by integrating the components 11, 20, 26, 40, and 46. Thereafter, the flange 11 can be mounted to the fuel tank 1. Thus, the assembling work of the fuel feed apparatus 10 can be facilitated.

Second Embodiment

Figure 4:
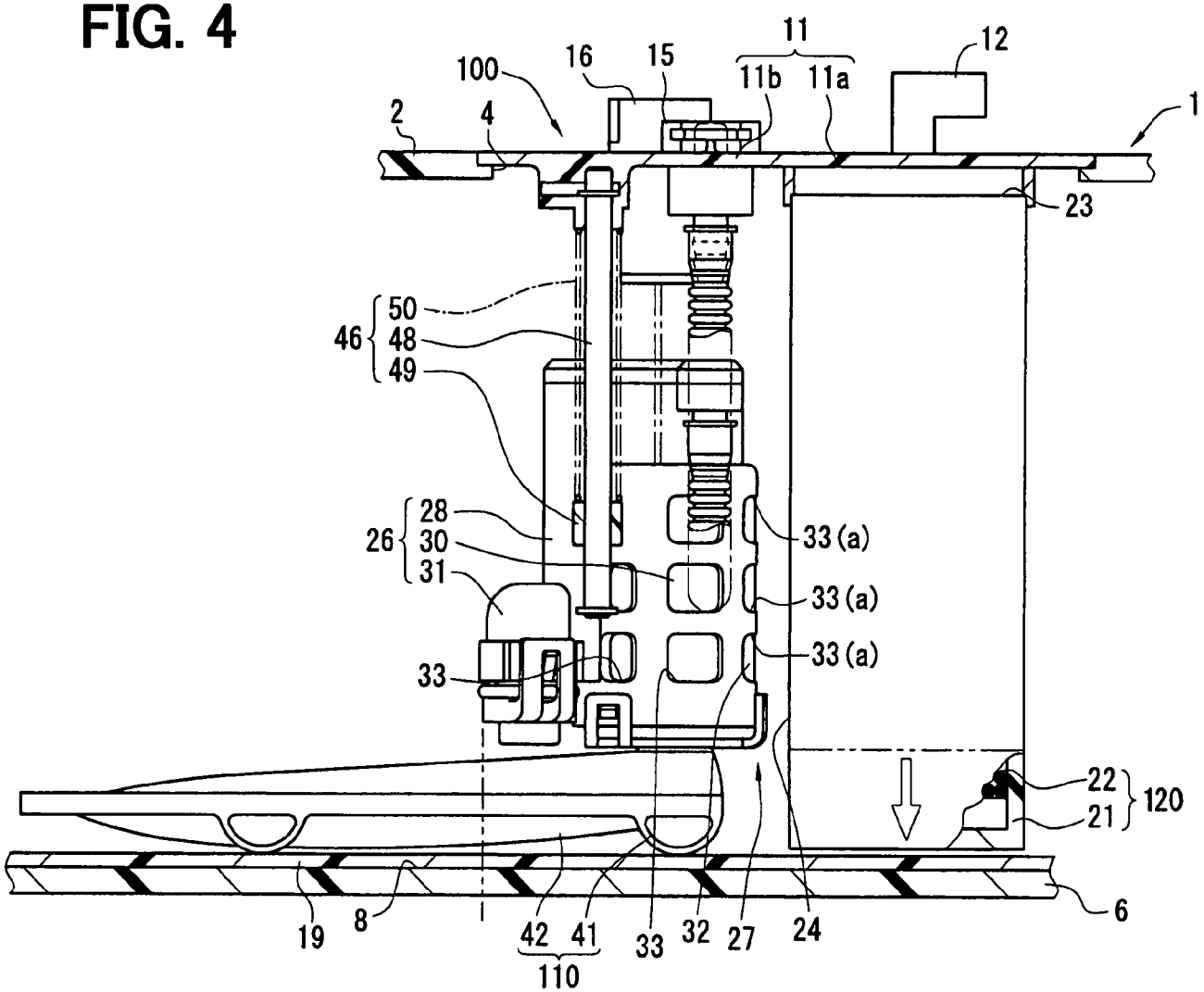
FIG. 4 is a partially cross sectional side view showing a fuel feed apparatus mounted to a fuel tank, according to a second embodiment of the present invention.

In this embodiment, as shown in FIG. 4, a fuel feed apparatus 100 has a suction filter 110, which is not arranged on the lower side of a canister 120. In this structure, the canister 120 further extends on the lower side, compared with the structure of the first embodiment. That is, the suction filter 110 is out of the area on the opposite side of the flange 11 with respect to the canister 120, so that the volume of the canister 120 increases on the opposite side of the flange 11. Furthermore, in this embodiment, the suction filter 110 protrudes to the opposite side of the canister 120 with respect to the pump unit 26 in this structure, in which the suction filter 110 becomes distant from the area on the opposite side of the flange 11 with respect to the canister 120. Therefore, the suction filter 110 protrudes out of the projection area of the flange 11.

Figure 5:
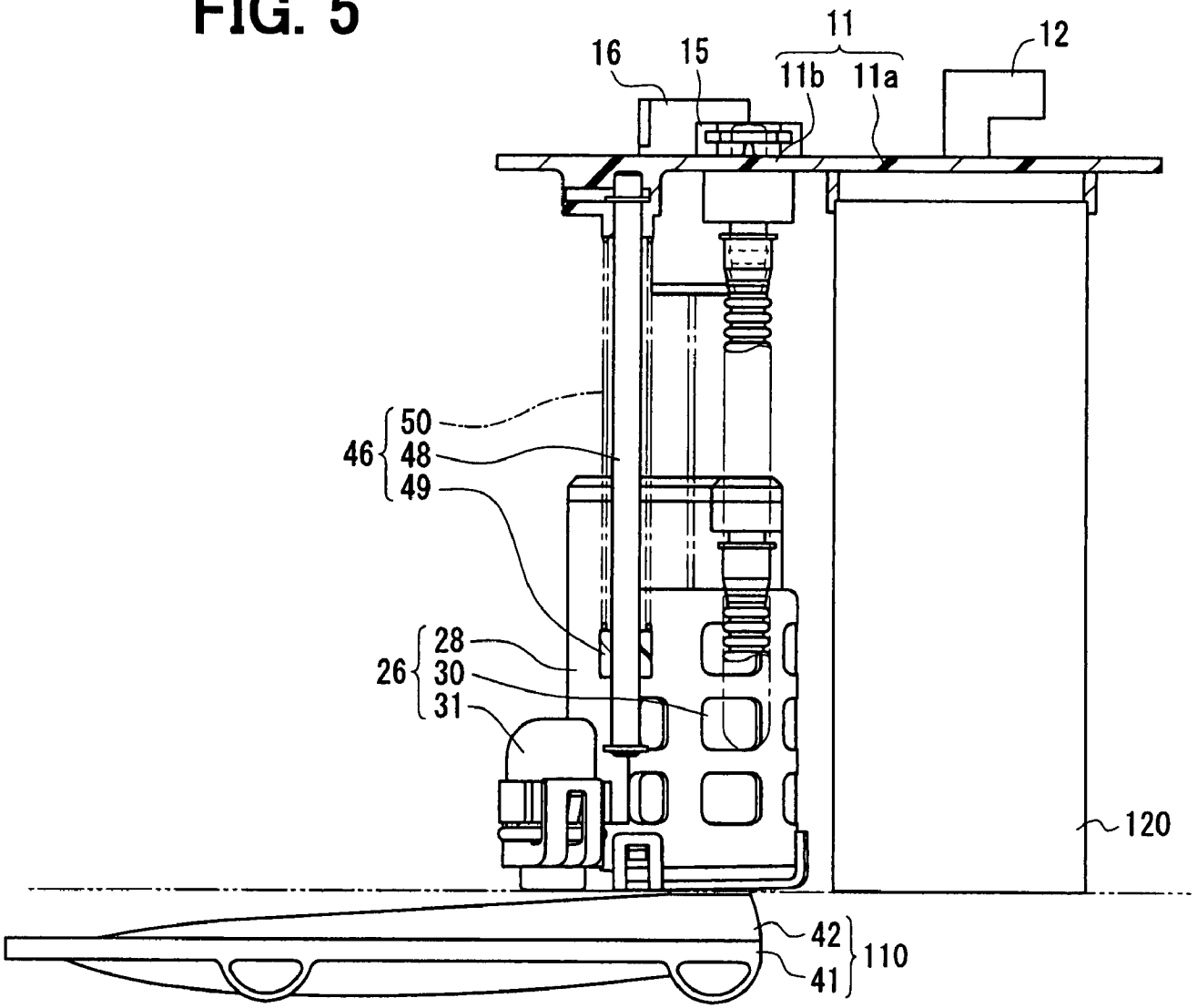
FIG. 5 is a partially cross sectional side view showing the fuel feed apparatus before being mounted to the fuel tank, according to the second embodiment.

In this embodiment, the compression sprig 50 is free in the fuel feed apparatus 100 before the fuel feed apparatus 100 is assembled to the fuel tank 1. In this condition, as shown in FIG. 5, the compression sprig 50 is substantially free from load. That is, load is not applied to the compression sprig 50, so that the compression sprig 50 extends to the substantially free length thereof, so that the suction filter 110 protrudes to the opposite side of the flange 11 with respect to the canister 120. When the fuel feed apparatus 100 is assembled to the fuel tank 1, the fuel feed apparatus 100 is vertically reduced in size, while the bottom portion 19 of the sub tank 18 presses the suction filter 110, which is inserted into the fuel tank 1, to the side of the flange 11, until the components 20, 26, 40, and 46 are completely accommodated in the fuel tank 1. Thereafter, as referred to FIG. 4, the flange 11 is attached to the upper portion 2 of the fuel tank 1, so that the assembling work of the fuel feed apparatus 100 is completed.

In this embodiment, the fuel feed apparatus 100 can be increased and reduced in size, in adapting to the volume of the fuel tank 1, while the canister 120 is increased in size. Thus, mountability of the fuel feed apparatus 100 can be enhanced, and a performance of the suction filter 110 for filtering fuel can be also enhanced.

The structure of the fuel feed apparatus is not limited to those in the above embodiments. For example, the sub tank may be omitted from the constructions of the first and second embodiments. In these structures, the suction filter 40, 110 may be mounted directly onto the inner wall 8 of the bottom portion 6 of the fuel tank 1, so that the adjustable unit 46 can be operative.

In the structure of the above first embodiment, the suction filter 40 may protrude out of the projection area of the flange 11.

Furthermore, in the structure of the above second embodiment, the suction filter 110 may be received in the projection area of the flange 11.

The above structures of the embodiments can be combined as appropriate.

Various modifications and alternations may be diversely made to the above embodiments without departing from the spirit of the present invention.

What is claimed is:

1. A fuel feed apparatus provided to a fuel tank, the fuel feed apparatus comprising:

a lid member that covers a through hole of the fuel tank;

a canister that connects with the lid member, the canister being accommodated in the fuel tank, the canister being adapted to removably absorbing fuel vapor in the fuel tank; and a fuel pump for pumping fuel in the fuel tank, wherein the canister has a cross section, which is in substantially semicircle having a chord, the canister has an outer peripheral wall that defines a space, which is on a lateral side of the chord of the cross section of the canister, in the fuel tank, and the space receives the fuel pump.

2. The fuel feed apparatus according to claim 1, further comprising:

a suction filter that is accommodated in the fuel tank, the suction filter being located on a substantially opposite side of the lid member with respect to the fuel pump, wherein the suction filter is adapted to filtering fuel drawn from the fuel tank into the fuel pump.

3. The fuel feed apparatus according to claim 2, wherein the canister, the fuel pump, and the suction filter are received in a projection area of the lid member on a side of the suction filter.

4. The fuel feed apparatus according to claim 2, wherein the suction filter is at least partially located on a substantially opposite side of the lid member with respect to the canister.

5. The fuel feed apparatus according to claim 2, wherein the canister has an end portion on an opposite side of the lid member, and the suction filter is radially away from said end portion of the canister.

6. The fuel feed apparatus according to claim 5, further comprising:

a bias member that biases the fuel pump and the suction filter to an inner wall of the fuel tank on an substantially opposite side of the lid member, wherein the suction filter protrudes to a substantially opposite side of the lid member beyond the canister when the bias member is substantially free from load.

7. The fuel feed apparatus according to claim 1, wherein the canister and the fuel pump are received in a projection area of the lid member on a side of an inner wall of the fuel tank.

8. The fuel feed apparatus according to claim 1, further comprising:

a pump holder that substantially surrounds an outer peripheral wall of the fuel pump, wherein the pump holder has a plurality of windows, through which the outer peripheral wall of the fuel pump opposes to the canister.

9. The fuel feed apparatus claim 1, further comprising:

a sub tank that is received in the fuel tank, wherein the sub tank accommodates the canister and the fuel pump, and the sub tank internally defines the space with respect to the canister.

10. A fuel feed apparatus provided to a fuel tank, the fuel feed apparatus comprising:

a lid member that covers a through hole of the fuel tank;

a canister that connects with the lid member, the canister being accommodated in the fuel tank, the canister being adapted to removably absorbing fuel vapor in the fuel tank;

a fuel pump that is located in a space on a lateral side of the canister in the fuel tank, the fuel pump being adapted to pumping fuel in the fuel tank; and a suction filter that is accommodated in the fuel tank for filtering fuel drawn from the fuel tank into the fuel pump, the suction filter being located on a substantially opposite side of the lid member with respect to the fuel pump, wherein the canister, the fuel pump, and the suction filter are received in a projection area of the lid member on the side of the suction filter, the suction filter is located on a side of a bottom portion of the fuel tank with respect to the fuel pump, and the suction filter extends in a longitudinal direction thereof along the bottom portion of the fuel tank.

11. The fuel feed apparatus according to claim 10, wherein the suction filter is at least partially located on a substantially opposite side of the lid member with respect to the canister.

12. The fuel feed apparatus according to claim 10, wherein the canister has an end portion on an opposite side of the lid member, and the suction filter is radially away from said end portion of the canister.

13. The fuel feed apparatus according to claim 12, further comprising:

a bias member that biases the fuel pump and the suction filter to an inner wall of the fuel tank on an substantially opposite side of the lid member, wherein the suction filter protrudes to a substantially opposite side of the lid member beyond the canister when the bias member is substantially free from load.

14. The fuel feed apparatus according to claim 10, wherein the canister and the fuel pump are received in a projection area of the lid member on a side of an inner wall of the fuel tank.

15. The fuel feed apparatus according to claim 10, further comprising:

a pump holder that substantially surrounds an outer peripheral wall of the fuel pump, wherein the pump holder has a plurality of windows, through which the outer peripheral wall of the fuel pump opposes to the canister.

16. The fuel feed apparatus claim 10, further comprising:

a sub tank that is received in the fuel tank, wherein the sub tank accommodates the canister and the fuel pump, and the sub tank internally defines the space with respect to the canister.

17. The fuel feed apparatus according to claim 10, wherein the suction filter is in a flat shape.

18. The fuel feed apparatus according to claim 10, wherein the suction filter is in contact with a bottom surface of the fuel tank.

* * * * *